US006470924B2

(12) United States Patent
Chen

(10) Patent No.: US 6,470,924 B2
(45) Date of Patent: Oct. 29, 2002

(54) DEPRESSION CONTAINER

(76) Inventor: Jen-Fu Chen, No. 835, Yuan Huan East Road, Fen Yuan City, Taichung Hsien (TW)

( * ) Notice: Subject to any disclaimer, the term of this patent is extended or adjusted under 35 U.S.C. 154(b) by 0 days.

(21) Appl. No.: 09/883,813

(22) Filed: Jun. 18, 2001

(65) Prior Publication Data

US 2002/0025254 A1 Feb. 28, 2002

(30) Foreign Application Priority Data

Jul. 27, 2000 (TW) ..... 089212983

(51) Int. Cl.[7] ..... B65B 1/04

(52) U.S. Cl. ..... 141/65; 141/95; 220/203.19; 53/210

(58) Field of Search ..... 141/65, 67, 192, 141/198, 95, 94; 220/203.19, 212, 228; 215/260, 270, 311; 53/510; 417/437; 99/472

(56) References Cited

U.S. PATENT DOCUMENTS 5,199,472 A * 4/1993 Rollison ..... 141/18
5,806,575 A * 9/1998 Tsay ..... 141/192

* cited by examiner

*Primary Examiner*—Steven O. Douglas
(74) *Attorney, Agent, or Firm*—Alan D. Kamrath; Rider, Bennett, Egan & Arundel

(57) ABSTRACT

A depression container includes a vessel including a compartment and a cover for enclosing and thus sealing the compartment. An air pump draws air out of the compartment and a pressure-activated switch controls on/off of the air pump. The pressure-activated switch detects an internal pressure in the compartment. The air pump is turned on when the internal pressure is higher than a predetermined first pressure value. The air pump is turned off when the internal pressure is lower than a predetermined second pressure value. In an alternative embodiments, the pressure-activated switch detects a pressure difference resulting from a closing motion of the cover on the vessel and turns the air pump on to thereby draw air out of the compartment of the vessel. The air pump is turned off when an internal pressure in the compartment detected by the pressure-activated switch is lower than a predetermined pressure value.

20 Claims, 7 Drawing Sheets

DEPRESSION CONTAINER

BACKGROUND OF THE INVENTION

1. Field of the Invention

The present invention relates to a depression container that is capable of maintaining the internal pressure under a predetermined value, and more particularly to a depression container equipped with an air pump that can be activated when the internal pressure in the depression container is below a predetermined value.

2. Description of the Related Art

A typical depression container includes a one-way valve and a user may manually operate a hand air pump to draw air out of the container via the one-way valve. The internal pressure of the container is thus reduced to a relatively low valve (almost vacuum). This reduces the risk of the articles in the container from being wetted or contaminated by dust or bacteria, thereby lengthening the preserve time. It is, however, troublesome and labor-intensive for the user to reciprocatingly operate the hand air pump for many times. In addition, the user cannot know the exact internal pressure in the depression container. Furthermore, the depression container cannot provide an absolute sealing effect such that the internal pressure in the depression container may rise after a period of time and thus adversely affect preservation of the articles in the depression container.

SUMMARY OF THE INVENTION

It is an object of the present invention to provide a depression container that may automatically draw air out of the depression container after a cover is attached to enclose an open end of the depression container. The internal pressure of the depression container is reduced to a predetermined value.

It is another object of the present invention to provide a depression container that clearly shows the value of the internal pressure. The depression container also allows the user to reset the internal pressure desired for preserving articles.

It is a further object of the present invention to provide a depression container that may maintain the internal pressure thereof under a predetermined valve for a long time.

In accordance with a first aspect of the invention, a depression container comprises:

a vessel including a compartment with an open end;

a cover for enclosing the open end of the vessel and thus sealing the compartment;

an air pump for drawing air out of the compartment of the vessel; and a pressure-activated switch for controlling on/off of the air pump;

the pressure-activated switch being capable of detecting an internal pressure in the compartment of the vessel, the air pump being turned on when the internal pressure is higher than a predetermined first pressure value, the air pump being turned off when the internal pressure is lower than a predetermined second pressure value that is smaller than the predetermined first pressure value.

In accordance with a second aspect of the invention, a depression container comprises:

a vessel including a compartment with an open end;

a cover for enclosing the open end of the vessel and thus sealing the compartment;

an air pump for drawing air out of the compartment of the vessel; and a pressure-activated switch for controlling on/off of the air pump;

the pressure-activated switch detecting a pressure difference resulting from a closing motion of the cover on the vessel and turning the air pump on to thereby draw air out of the compartment of the vessel, the air pump being turned off when an internal pressure in the compartment detected by the pressure-activated switch is lower than a predetermined pressure value.

Thus, the air pump is activated by a pressure difference resulting from the closing motion of the cover, and the pump is deactivated after the internal pressure in the vessel is reduced to a first predetermined pressure value. When the internal pressure rises and exceeds a second predetermined pressure value higher than the first predetermined value, the pump is activated again until the internal pressure is reduced to the first predetermined pressure value. Thus, the articles in the vessel can be preserved for a long time by means of maintaining the internal pressure in the vessel under a predetermined low pressure suitable for preservation of articles.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
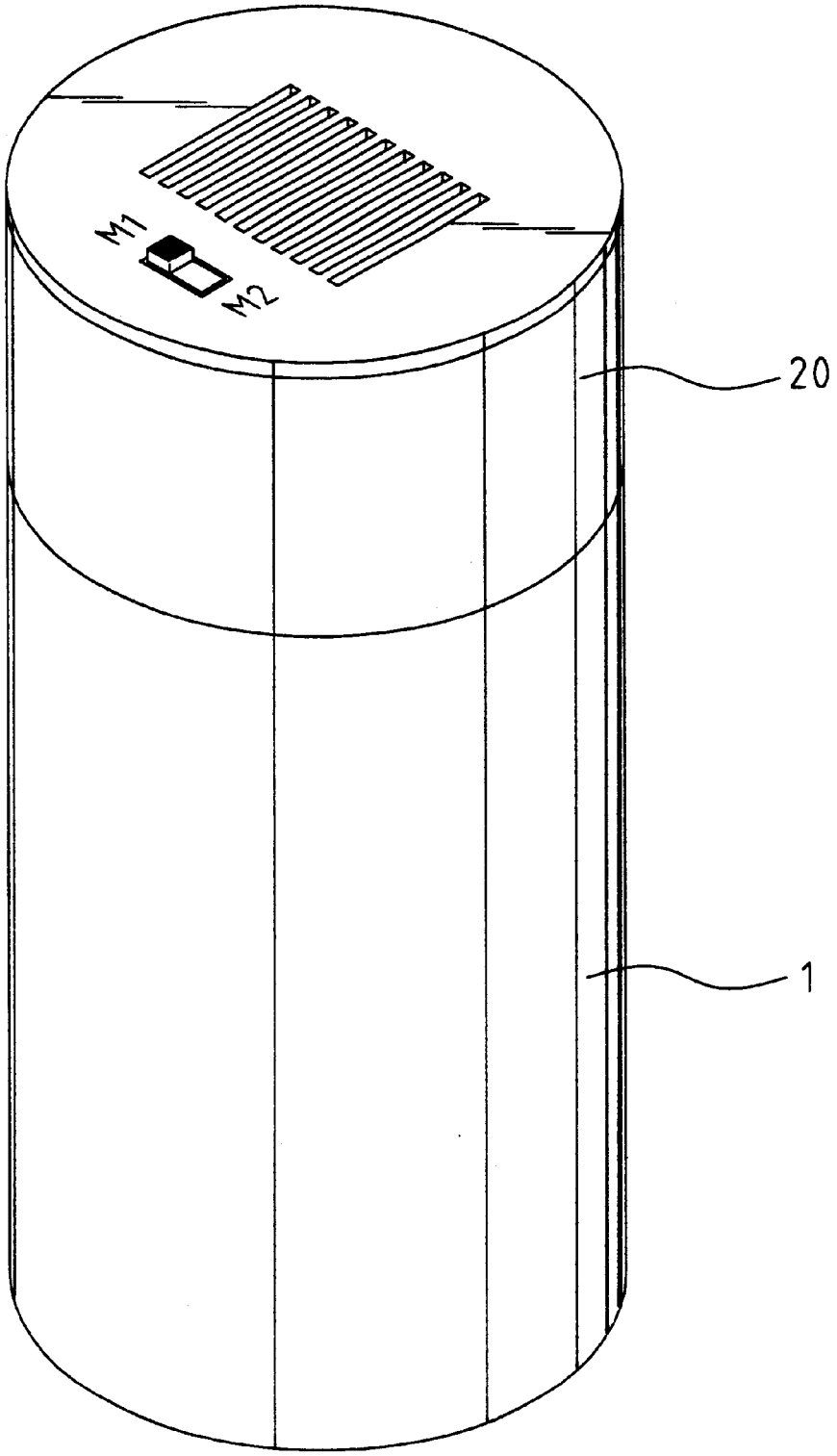
FIG. 1 is a perspective view of a depression container in accordance with the present invention.
Figure 2:
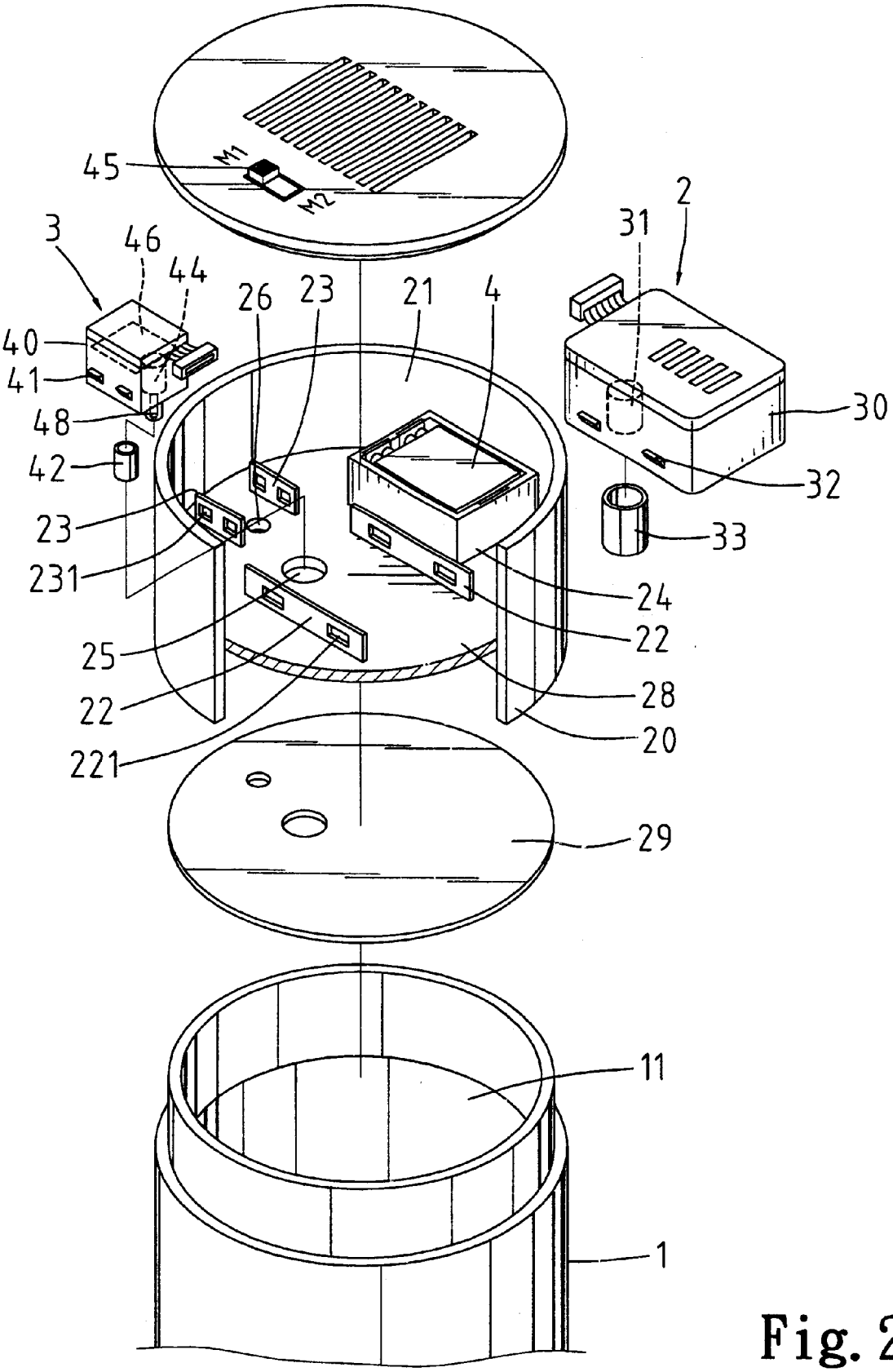
FIG. 2 is an exploded perspective view of the depression container in accordance with the present invention.
Figure 3:
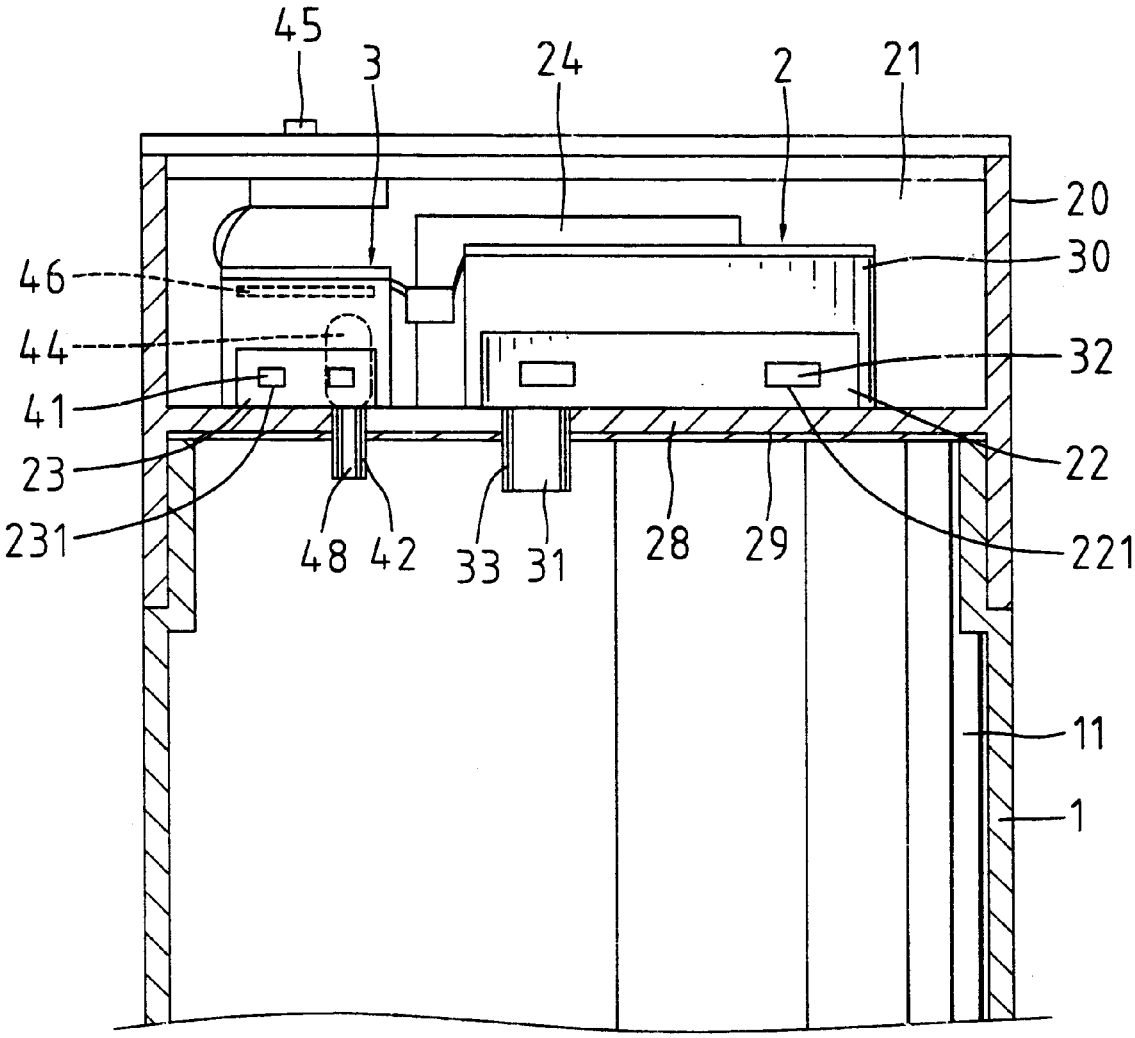
FIG. 3 is a sectional view of an upper portion of the depression container in accordance with the present invention.

Referring to FIGS. 1 through 3, a depression container in accordance with the present invention generally includes a vessel 1, a cover 20, an air pump 2, a pressure-activated switch 3, and a battery unit 4.

The vessel 1 is cylindrical and includes a closed lower end and an open upper end and thus defines a compartment 11 for receiving articles to be preserved. The compartment 11 is enclosed and thus sealed by the cover 20 that is attached to the open upper end of the vessel 1. The cover 20 includes a sealing plate 28 (FIG. 3), which also serves as a mounting plate. Namely, the sealing plate 28 seals the compartment 11 and provides a base on which the air pump 2, the pressure-activated switch 3, and the battery unit 4 are mounted. In this embodiment, a space 21 is defined above the sealing plate 28, and two parallel first walls 22, two parallel second walls 23, and a battery seat 24 are formed on top of the sealing plate 28, best shown in FIG. 2. Each first wall 22 includes, e.g., two slots 221 and each second wall 23 includes, e.g., two slots 231. The sealing plate 28 farther includes a first through-hole 25 and a second through-hole 26 that are communicated with the compartment 11 of the vessel 1, which will be described in detail later.

The air pump 2 includes a casing 30 and an air duct 31 extending from a bottom side of the casing 30. The casing 30 further includes two lateral sides each having two engaging members 32 for engaging with the slots 221 of the associated wall 22, thereby securely mounting the air pump 2 into the space 21 of the cover 20. An airtight sleeve 33 is extended through the first through-hole 25. The air duct 31 is mounted in the airtight sleeve 33 and thus located below the sealing plate 28, best shown in FIG. 3. Of course, an additional sealing plate 29 can be provided between the upper end face of the vessel 1 and the sealing plate 28 to assist in the sealing effect.

The pressure-activated switch 3 includes a casing 40, a differential type pressure transducer 44 in the casing 40, and a control chip 46. The pressure transducer 44 includes a sensor 48 that extends downward beyond the casing 40. The casing 40 includes two lateral sides each having two engaging members 41 for engaging with the slots 231 of the associated wall 23, thereby mounting the pressure-activated switch 3 into the space 21 of the cover 20. An airtight sleeve 42 is extended through the second through-hole 26, and the sensor 48 is mounted in the airtight sleeve 42 and thus located below the sealing plate 28, best shown in FIG, 3.

The battery unit 4 is mounted to the battery seat 24 in the cover 20 for powering the pressure-activated switch 3 and the air pump 2.

The pressure transducer 44 outputs a voltage in response to a difference between a reference pressure (e.g., the atmosphere) and a detected internal pressure in the compartment 11 of the vessel. Namely, the output voltage of the pressure transducer 44 is in linear proportion to the pressure difference, In this embodiment, the output voltage is 3.3V if the detected internal pressure is equal to or above a first threshold pressure value (e.g., 1.15 atm); the output voltage is 1.2V if the detected internal pressure is equal to or below a second threshold pressure value (e.g., 0.1 atm); and the output voltage is 1.5V if the detected internal pressure is equal to or above a third threshold pressure value (e.g., 0.25 atm).

The control chip 46 has a set of controlling programs recorded therein and includes two logic control modes M1 and M2 switchable by a switch 45. When switched to the control mode M1, the air pump 2 is activated when the output voltage of the pressure transducer 44 is higher than or equal to 3.3V and the air pump 2 is turned off when the output voltage of the pressure transducer 44 is lower than or equal to 1.2V. When switched to the control mode M2, the air pump 2 is activated when the output voltage of the pressure transducer 44 is higher than or equal to 1.5V and the air pump 2 is turned off when the output voltage of the pressure transducer 44 is lower than or equal to 1.2V.

Figure 4:
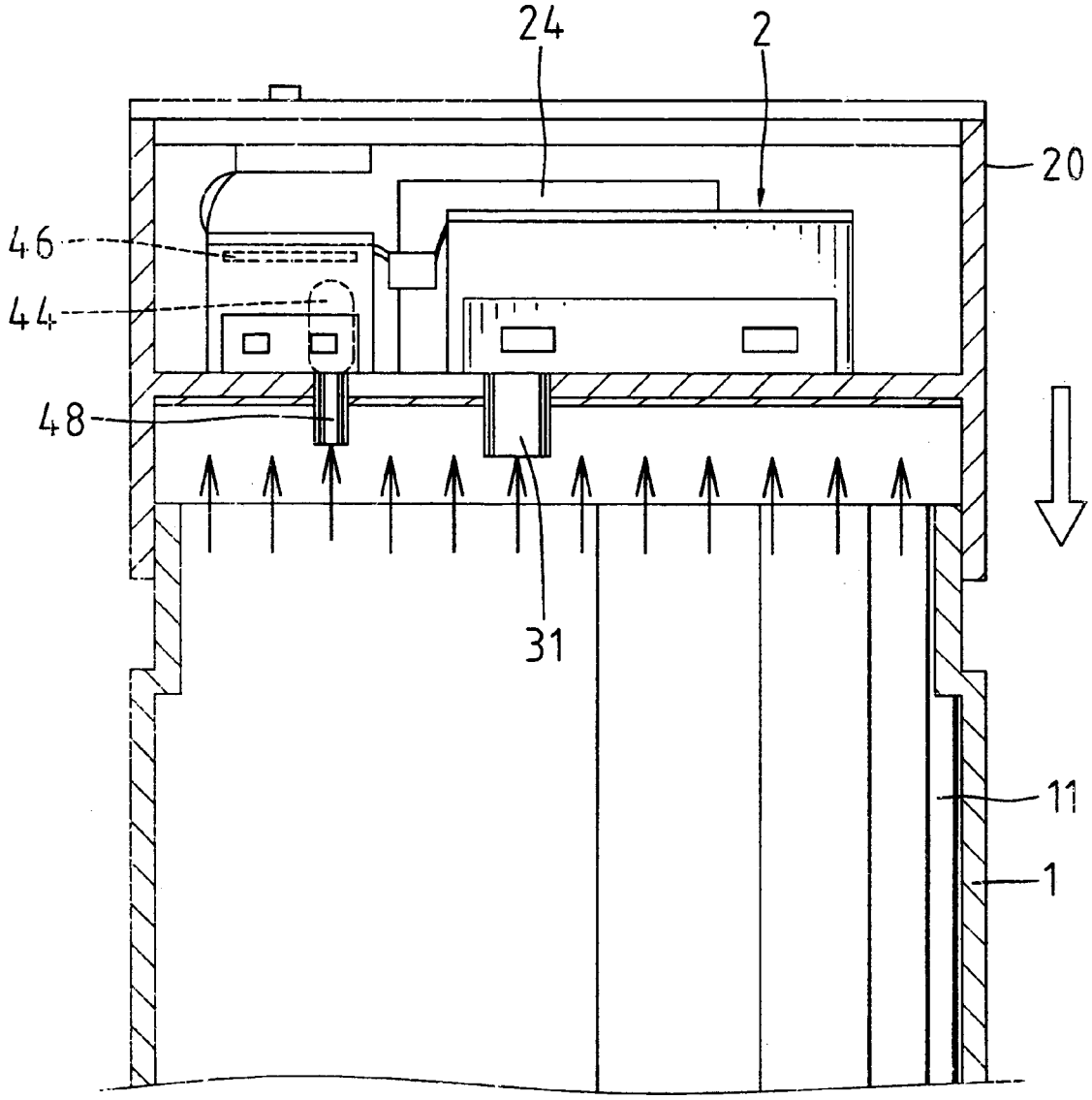
FIG. 4 is a sectional view similar to FIG. 3, illustrating operation of the depression container upon closing of a cover.
Figure 5:
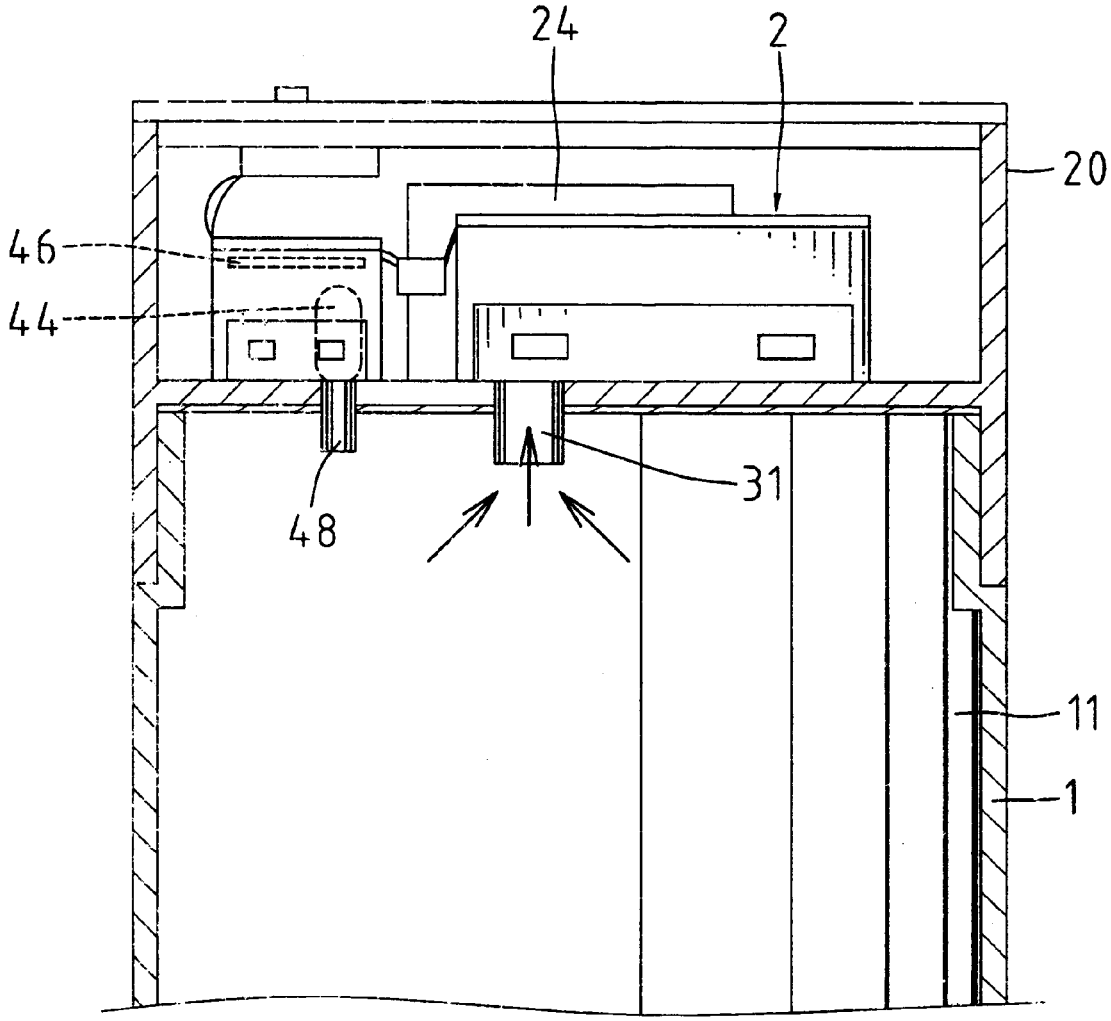
FIG. 5 is a sectional view similar to FIG. 4, wherein the cover is moved to its fully closed position.

In use, referring to FIG. 4, the switch 45 is first switched to the control mode Ml, and the cover 20 is attached to and thus encloses the vessel 1. During closing of the cover 20 (i.e., the cover 20 is moved downward relative to the vessel 1), the air inside compartment 11 of the vessel 1 is compressed and thus generates an instant pressure greater than 1.15 atm. The pressure transducer 44 of the pressure-activated switch 3 detects such a pressure and outputs a voltage higher than 3.3V The air pump 2 is thus activated under the control of the control chip 46, thereby drawing air out of the vessel 1 (e.g. vacuumizing the vessel 1). The pressure in the vessel 1 is accordingly reduced. When the air pressure in the vessel 1 is equal to or below 0.1 atm, the output voltage of the pressure transducer 44 is lower than 1.2V. The air pump 2 is thus turned off.

The switch 45 is switched to the control mode M2 after depression. If the air pressure in the vessel 1 rises as a result of entrance of ambient air into the vessel 1, the sensor 48 detects the air pressure and the air pump 2 is turned on when the air pressure in the vessel 1 is equal to or above 0.25 atm upon outputting an output voltage higher than 1.5V. When the air pressure inside the vessel 1 is equal to or lower than 0.1 atm, the pressure transducer 44 outputs a voltage lower than 1.2V to turn off the air pump 2. Thus, the air pressure in the vessel 1 is kept at about 0.1 atm.

It is appreciated that the switch 45 and the control modes M1 and M2 can be simplified. For example, the control mode M1 is OFF, and the control mode M2 is ON, More specifically, the pressure transducer 44 is turned on when in the control mode M2 and is turned off when in the control mode M1. Thus, when in use, the user may attach the cover 20 to the vessel 1 and switch to the control mode M2 after the cover 20 is in position. The air pump 2 is turned on when the air pressure in the vessel 1 is equal to or above 0.25 atm and the air pump 2 is turned off when the air pressure in the vessel 1 is equal to or lower than 0.1 atm.

Figure 6:
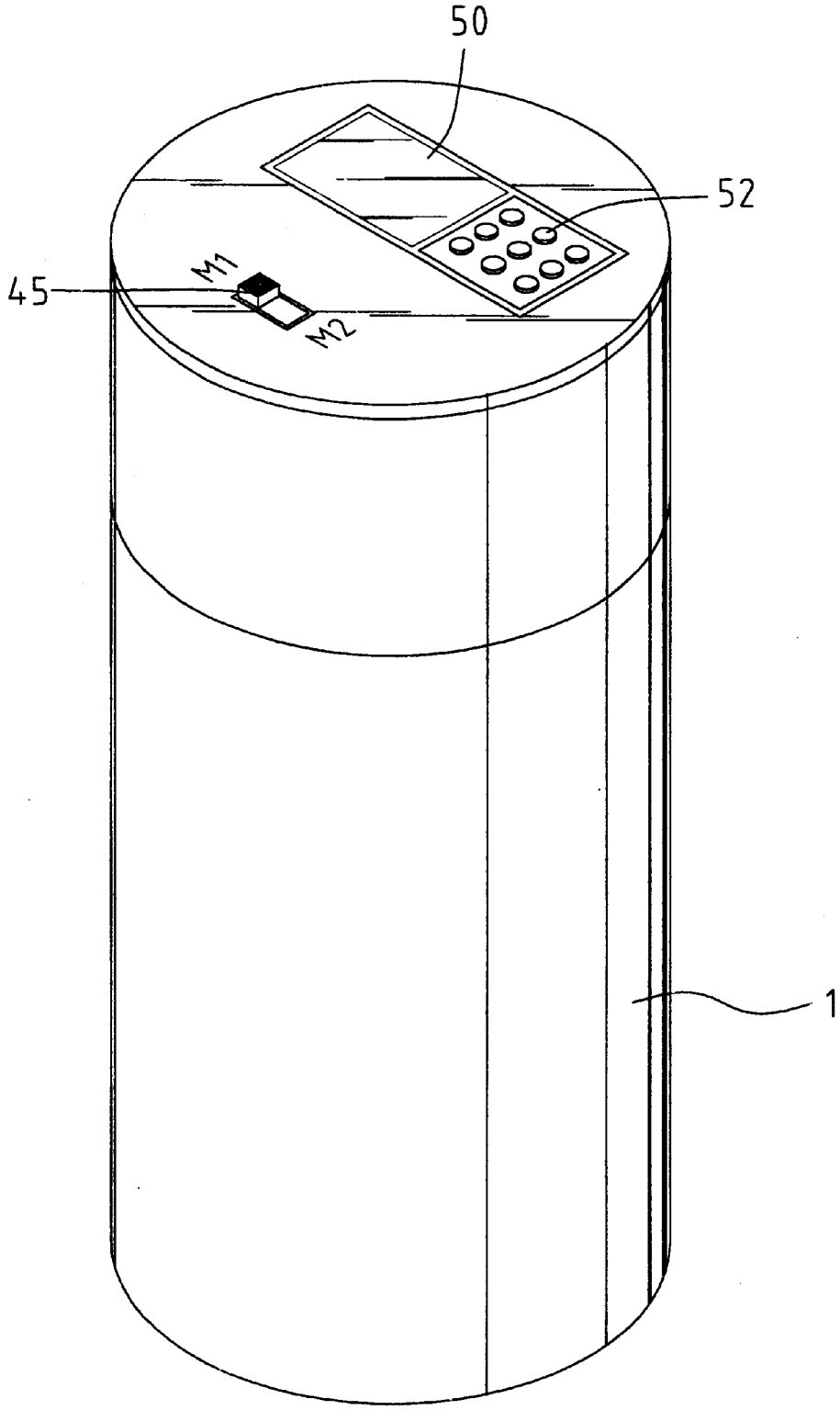
FIG. 6 is a perspective view illustrating a modified embodiment of the depression pump in accordance with the present invention.

In addition, referring to FIG. 6, the cover 20 may include a display 50 (e.g., a liquid crystal display) to display the air pressure in the vessel 1. The cover 20 may further include an input device 52 for inputting the pressure value at which the articles in the vessel are to be kept. Namely, the user may change the second threshold value (0.1 atm in the above embodiment) to any desired value. The input device 52 may also be used to input the name of the articles to be preserved in the vessel 1.

Figure 7:
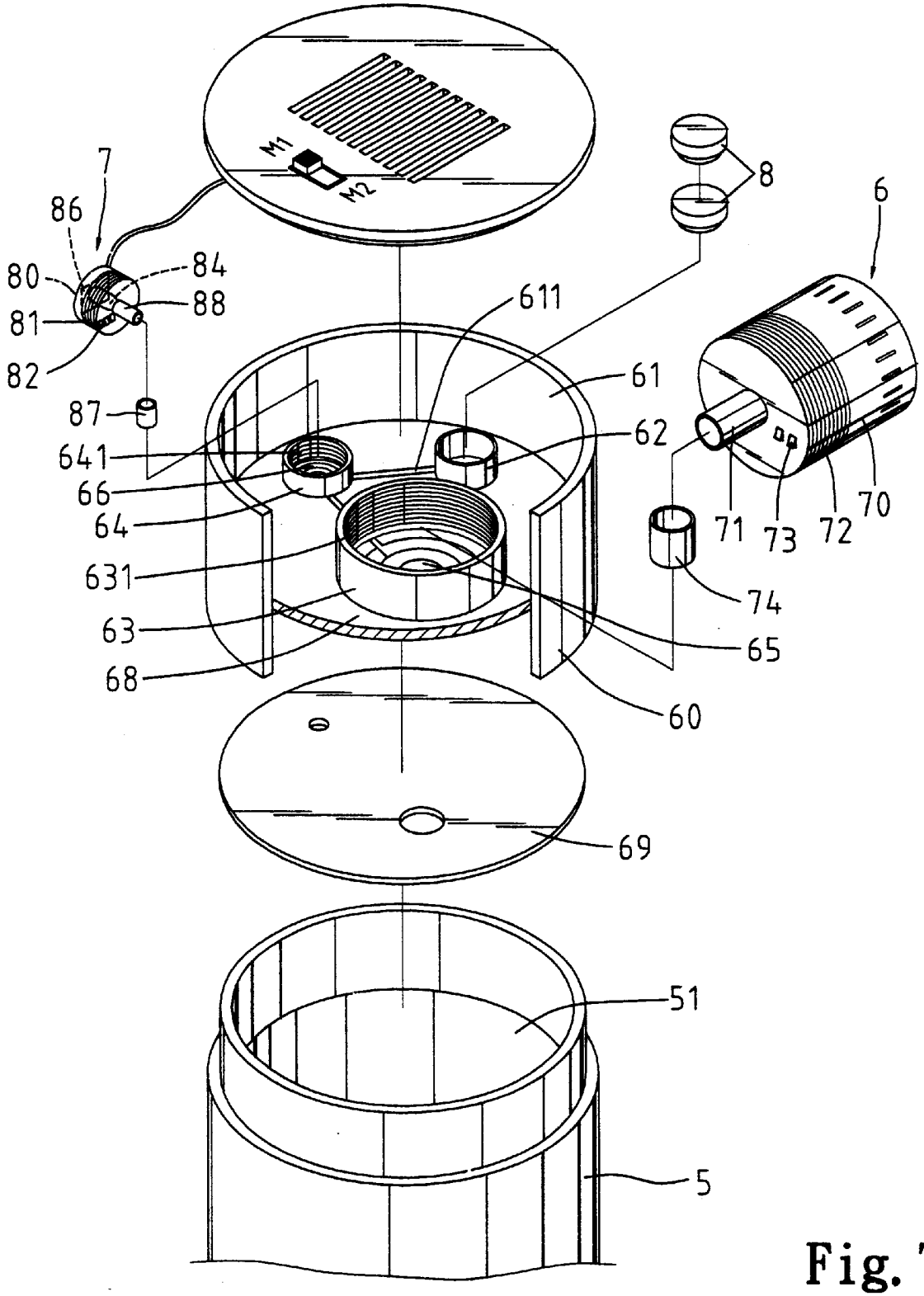
FIG. 7 is an exploded perspective view illustrating a further modified embodiment of the depression pump in accordance with the present invention.

FIG. 7 illustrates a modified embodiment of the depression container in accordance with the present invention. The depression container includes a vessel 5, a cover 60, an air pump 6, a pressure-activated switch 7, and a battery unit 8.

The vessel 5 is cylindrical and includes a closed lower end and an open upper end and thus defines a compartment 51 for receiving articles to be preserved. The compartment 51 is enclosed and thus sealed by the cover 60 that is attached to be open upper end of the vessel 5. The cover 60 includes a sealing plate 68, which also serves as a mounting plate, Namely, the sealing plate 68 seals the compartment 51 and provides a base on which the air pump 6, the pressure-activated switch 7, and the battery unit 8 are mounted. In this embodiment, a space 61 is defined above the sealing plate 68 and an annular battery seat 62, a first cylindrical wall 63, and a second cylindrical wall 64 are formed on top of the sealing plate 68. The annular battery seat 62 defines a seat for receiving the battery unit 8. The sealing plate 68 further includes a first through-hole 65 surrounded by the first cylindrical wall 63 and a second through-hole 66 surrounded by the second cylindrical wall 64, The through-holes 65 and 66 are communicated with the compartment 51 of the vessel 5.

The air pump 6 includes a casing 70 and an air duct 71 extending from a bottom side of the casing 70. An outer threading 72 is defined in an outer periphery of the casing 70 for engaging with an inner threading 631 of the first cylindrical wall 63, thereby securely mounting the air pump 6 to the fist cylindrical wall 63. An airtight sleeve 74 is extended through the first through-hole 65. The air duct 71 is mounted in the airtight sleeve 74 and thus located below the sealing plate 68. Of course, an additional sealing plate 69 can be provided between the upper end face of the vessel 5 and the sealing plate 68 to assist in the sealing effect.

The pressure-activated switch 7 includes a casing 80, a differential type pressure transducer 84 in the casing 80, and a control chip 86. The pressure transducer 84 includes a sensor 88 that extends downward beyond the casing 80. The casing 80 includes an outer threading 81 in an outer periphery thereof for engaging with an inner threading 641 of the second cylindrical wall 64, thereby mounting the pressure-activated switch 7 into the space 61 of the cover 60. An airtight sleeve 87 is extended through the second through-hole 66, and the sensor 88 is mounted in the airtight sleeve 87 and thus located below the sealing plate 68.

The battery unit 8 is mounted to the battery seat 62 in the cover 60 for powering the pressure-activated switch 7 and the air pump 6.

The sealing plate 68 further includes preserved passages 611 allowing electrical connection between the battery seat 62 and terminals 82 and 73 respectively on the pressure-activated switch 7 and the air pump 6. Operation of the modified embodiment is identical to that of the first embodiment illustrated in FIGS. 1 through 5.

Although the invention has been explained in relation to its preferred embodiment, it is to be understood that many other possible modifications and variations can be made without departing from the scope of the invention as hereinafter claimed.

What is claimed is:

1. A depression container comprising;

a vessel including a compartment with an open end;

a cover for enclosing the open end of the vessel and thus sealing the compartment;

an air pump for drawing air out of the compartment of the vessel;

a pressure-activated switch for controlling on/off of the air pump; and a battery unit for powering the pressure-activated switch and the air pump;

the pressure-activated switch being capable of detecting an internal pressure in the compartment of the vessel, the air pump being turned on when the internal pressure is higher than a predetermined first pressure value, the air pump being turned off when the internal pressure is lower than a predetermined second pressure value that is smaller than the predetermined first pressure value.

2. The depression container as claimed in claim 1, further comprising a battery unit for powering the pressure-activated switch and the air pump.

3. The depression container as claimed in claim 1, wherein the cover comprises a space for receiving the pressure-activated switch and the air pump.

4. The depression container as claimed in claim 3, with the battery unit mounted in the space for powering the pressure-activated switch and the air pump.

5. The depression container as claimed in claim 1, further comprising means for inputting the predetermined first pressure value and the predetermined second pressure value.

6. The depression container as claimed in claim 1, further comprising a switch for controlling on/off of the pressure-activated switch.

7. The depression container as claimed in claim 1, further comprising means for inputting a name of an article to be preserved in the vessel.

8. A depression container comprising:

a vessel including a compartment with an open end;

a cover for enclosing the open end of the vessel and thus sealing the compartment;

an air pump for drawing air out of the compartment of the vessel;

a pressure-activated switch for controlling on/off of the air pump; and means for inputting a name of an article to be preserved in the vessel;

the pressure-activated switch being capable of detecting an internal pressure in the compartment of the vessel, the air pump being turned on when the internal pressure is higher than a predetermined first pressure value, the air pump being turned off when the internal pressure is lower than a predetermined second pressure value that is smaller than the predetermined first pressure value.

9. The depression container as claimed in claim 8, farther comprising means for inputting the predetermined first pressure value and the predetermined second pressure value.

10. A depression container comprising;

a vessel including a compartment with an open end;

a cover for enclosing the open end of the vessel and thus sealing the compartment;

an air pump for drawing air out of the compartment of the vessel; and a pressure-activated switch for controlling on/off of the air pump;

the pressure-activated switch detecting a pressure difference resulting from a closing motion of the cover on the vessel and turning the air pump on to thereby draw air out of the compartment of the vessel, the air pump being turned off when an internal pressure in the compartment detected by the pressure-activated switch is lower than a predetermined pressure value, wherein the pressure-activated switch comprises a differential type pressure transducer and a control chip, the pressure transducer having a sensor extended into the compartment of the vessel for detecting the internal pressure in the compartment and outputting a voltage to the control chip in response to a difference between a reference pressure and the internal pressure detected by the sensor.

11. The depression container as claimed in claim 10, wherein the reference pressure is the atmospheric pressure.

12. The depression container as claimed in claim 10, further comprising a battery unit for powering the pressure-activated switch and the air pump.

13. The depression container as claimed in claim 12, wherein the battery unit is removably mounted in the cover.

14. The depression container as claimed in claim 10, wherein the cover comprises a space for receiving the pressure-activated switch and the air pump.

15. The depression container as claimed in claim 14, further comprising a battery unit mounted in the space for powering the pressure-activated switch and the air pump.

16. The depression container as claimed in claim 14, wherein the cover comprises a sealing plate securely mounted therein for supporting the air pump and the pressure-activated switch, the sealing plate including a first through-hole and a second through-hole that are communicated with the compartment, a first airtight sleeve being extended through the first through-hole, an air duct extending from the air pump into the compartment via the first airtight sleeve, a second airtight sleeve being extended through the second through-hole, the sensor being extended into the compartment via the second airtight sleeve.

17. The depression container as claimed in claim 16, wherein the sealing plate further comprises a first cylindrical wall surrounding the first through-hole and a second cylindrical wall surrounding the second through-hole, the first cylindrical wall including an inner threading, the air pump including an outer threading for threading engagement with the inner threading of the first cylindrical wall, the second cylindrical wall including an inner threading, the pressure-activated switch including an outer threading for threading engagement with the inner threading of the second cylindrical wall.

18. The depression container as claimed in claim 10, further comprising means for inputting the predetermined pressure value.

19. The depression container as claimed in claim 10, further comprising means for inputting a name of an article to be preserved in the vessel.

20. The depression container as claimed in claim 10, further comprising a switch movable between a first position for automatic operation in which the air pump draws air out of the compartment of the vessel upon the pressure difference generated as a result of the closing motion of the cover and a second position for manual operation in which the air pump is activated to draw air out of the compartment when the detected internal pressure in the compartment is higher than a predetermined second pressure value.

* * * * *